US006343970B1

(12) United States Patent
Lee et al.

(10) Patent No.: US 6,343,970 B1
(45) Date of Patent: Feb. 5, 2002

(54) DRIVING APPARATUS FOR A DOLL

(76) Inventors: Ching-Chuan Lee, No. 9, Lane 50, Sec. 3, Muhsin Road; Hung-Chien Fan, 2F, No. 1, Alley 100, Lane 109, Sec. 2, Muja Road, both of Taipei (TW)

( * ) Notice: Subject to any disclaimer, the term of this patent is extended or adjusted under 35 U.S.C. 154(b) by 0 days.

(21) Appl. No.: 09/593,478

(22) Filed: Jun. 14, 2000

(51) Int. Cl.[7] ..... A63H 3/20
(52) U.S. Cl. ..... 446/330; 446/297; 446/298
(58) Field of Search ..... 446/268, 297, 446/298, 299, 302, 330, 376

(56) References Cited

U.S. PATENT DOCUMENTS

| | | | | | |
|---|---|---|---|---|---|
| 4,623,318 | A | * | 11/1986 | Tsiknopoulos et al. | 446/330 |
| 5,890,947 | A | * | 4/1999 | Tanaka et al. | 446/298 |
| 5,911,617 | A | * | 6/1999 | Chou | 446/353 |
| 6,017,261 | A | * | 1/2000 | Wachtel | 446/301 |
| 6,036,572 | A | * | 3/2000 | Sze | 446/177 |
| 6,135,848 | A | * | 11/2000 | Hou | 446/353 |

* cited by examiner

*Primary Examiner*—Kien T. Nguyen
*Assistant Examiner*—F Francis
(74) *Attorney, Agent, or Firm*—Troxell Law Office PLLC

(57) ABSTRACT

A driving apparatus for a doll comprises a battery case containing at least one battery, a circuit board with an electronic switch, two opposite housing halves, and a driving part. Each of the housing halves at an inner wall thereof has an engaging hole, and two flips to form a groove. The driving part further comprises a left casing half, a right casing half, a right casing half, a motor, a speed reduction mechanism, and a swinging cam. The left casing half has an inner straight rail, an engaging projection at the top thereof, and a left engaging projection thereon to fit with the engaging hole. The right casing half has an upper part and a right engaging projection to fit with the engaging hole either. The motor with an output shaft being connects with the electronic switch. The speed reduction mechanism is formed by a belt and/or a gear shaft with an end thereof being associated with the output shaft on the motor and is provided with a swinging gear output shaft. The swinging cam has two eccentric shafts with respect to an axis to fit with the swinging gear output shaft. Once the motor is started, the swinging cam is restricted by the groove to allow the driving part performing swinging movements.

5 Claims, 4 Drawing Sheets

DRIVING APPARATUS FOR A DOLL

BACKGROUND OF THE INVENTION

1. Field of The Invention

The present invention relates to a driving apparatus for a doll, and particularly to a driving apparatus received in an doll and liked with a phone.

2. Description of Related Art

The mobile phone is very popularly used in our daily life in addition to the traditional telephone set. Because it is easily portable, the mobile phone makes the communication by phone much handier accordingly. It is the reason why the mobile phone is widely loved by a great deal of consumers and it has become almost every one got one mobile phone.

Although it is very convenient for us to carry a mobile phone while going out, in fact, the mobile phone is frequently kept in a state of on even if we are spending a great part of the time in the office or in the house. However, it is worth us to consider that if it is necessary to hold the mobile phone in case of receiving a call or making a call while we are not out.

For a traditional telephonic apparatus, there is a non-holding device designed for the hand holding set of the telephonic apparatus in the office. The feature of the non-holding device allows the hands not to be interrupted and keep doing a work has to be done.

By the same token, a non-holding device being designed for the mobile phone is helpful for hands keeping doing work at hand in the office or in the house. Other device designed for such as keeping away from the electromagnetic wave is useful either and a Japanese Utility Model registration numbered 3038524 discloses a device to prevent from contacting the electromagnetic wave generating from the mobile phone.

Of course the non-holding device adapting to the mobile phone is required to lay on a desk or be exposed outward such that it can be appended a function such as increasing an visional amusement and fun in addition to receiving a call or making a call.

SUMMARY OF THE INVENTION

An object of the present invention is to provide a driving apparatus for a doll, with which the doll can perform specific movements while a phone connecting therewith receiving a call or making a call.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
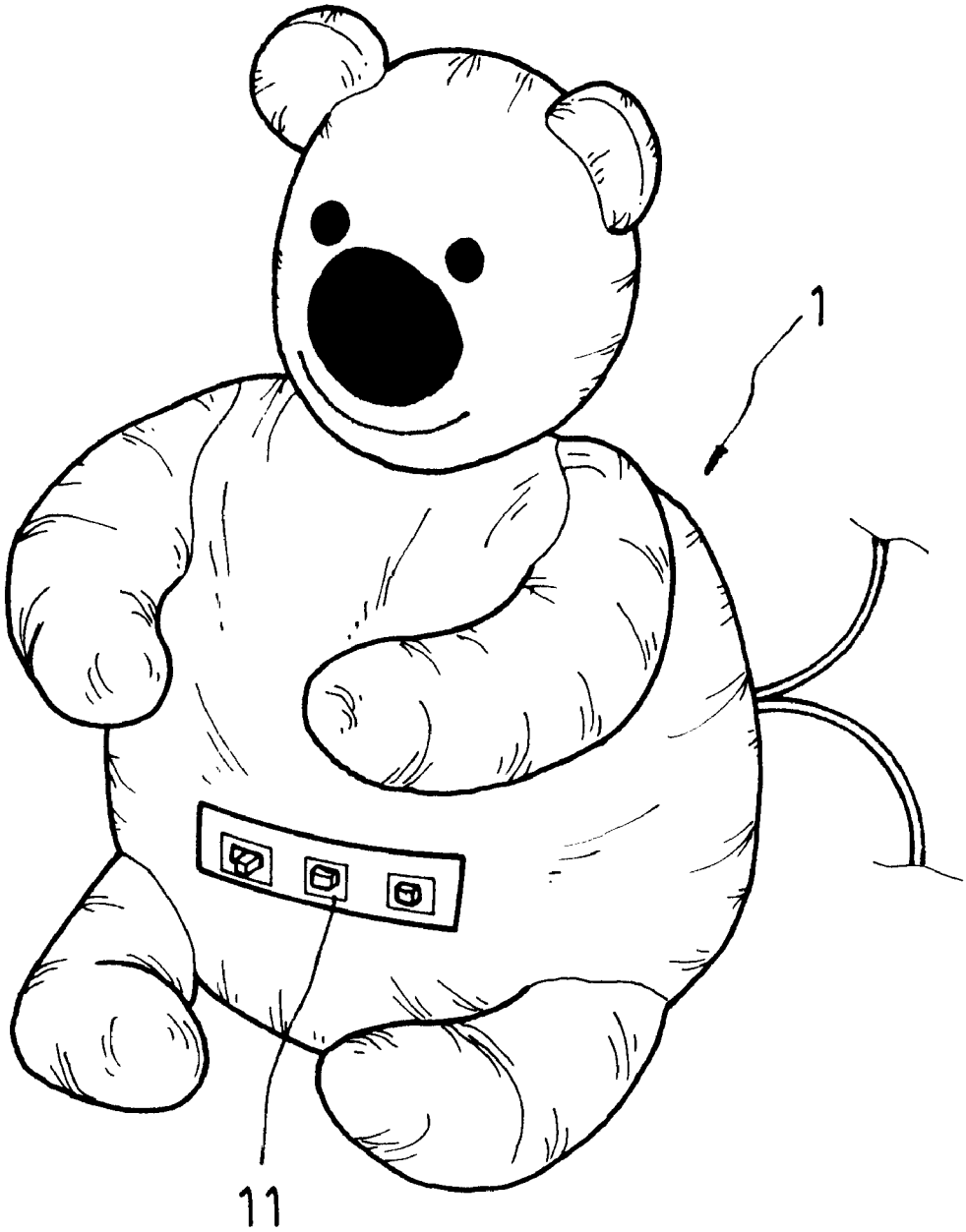
FIG. 1 is a perspective view of a doll providing a driving apparatus in a preferred embodiment according to the present invention.
Figure 2:
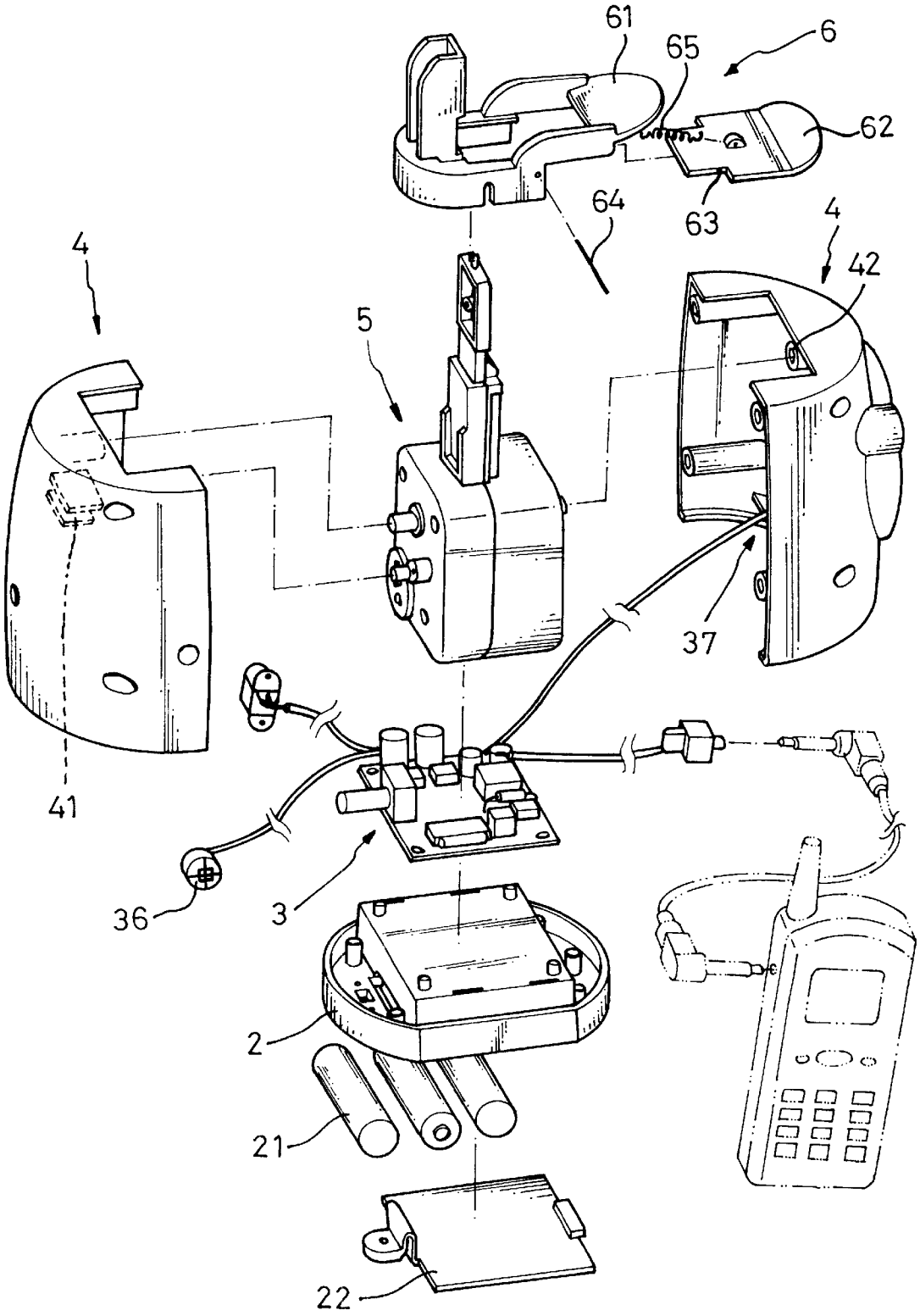
FIG. 2 is an exploded perspective view of the driving apparatus for the doll shown in FIG. 1.

Referring to FIGS. 1 and 2, a driving apparatus for a doll in a preferred embodiment according to the present invention basically comprises an outer cover 1, a battery case 2, a circuit board 3, a housing 4, a driving part 5, and a driven part 6.

The outer cover 1 is an appearance of a doll and the shape of the doll is optional. A control switch 11 is provided on the outer cover 1 and a room is provided in the outer cover 1 to receive other components described hereinafter.

The battery case 2 is the power supply for the apparatus and at least one battery 21 is located in the case 2. The battery 21 may be an ordinary battery or a rechargeable battery. A lower lid 22 is located at the bottom of the battery case 2 to prevent the battery 21 from moving outward. The power is connected to the circuit board 3 and this is a prior art so that no further detail will be described.

Figure 4:
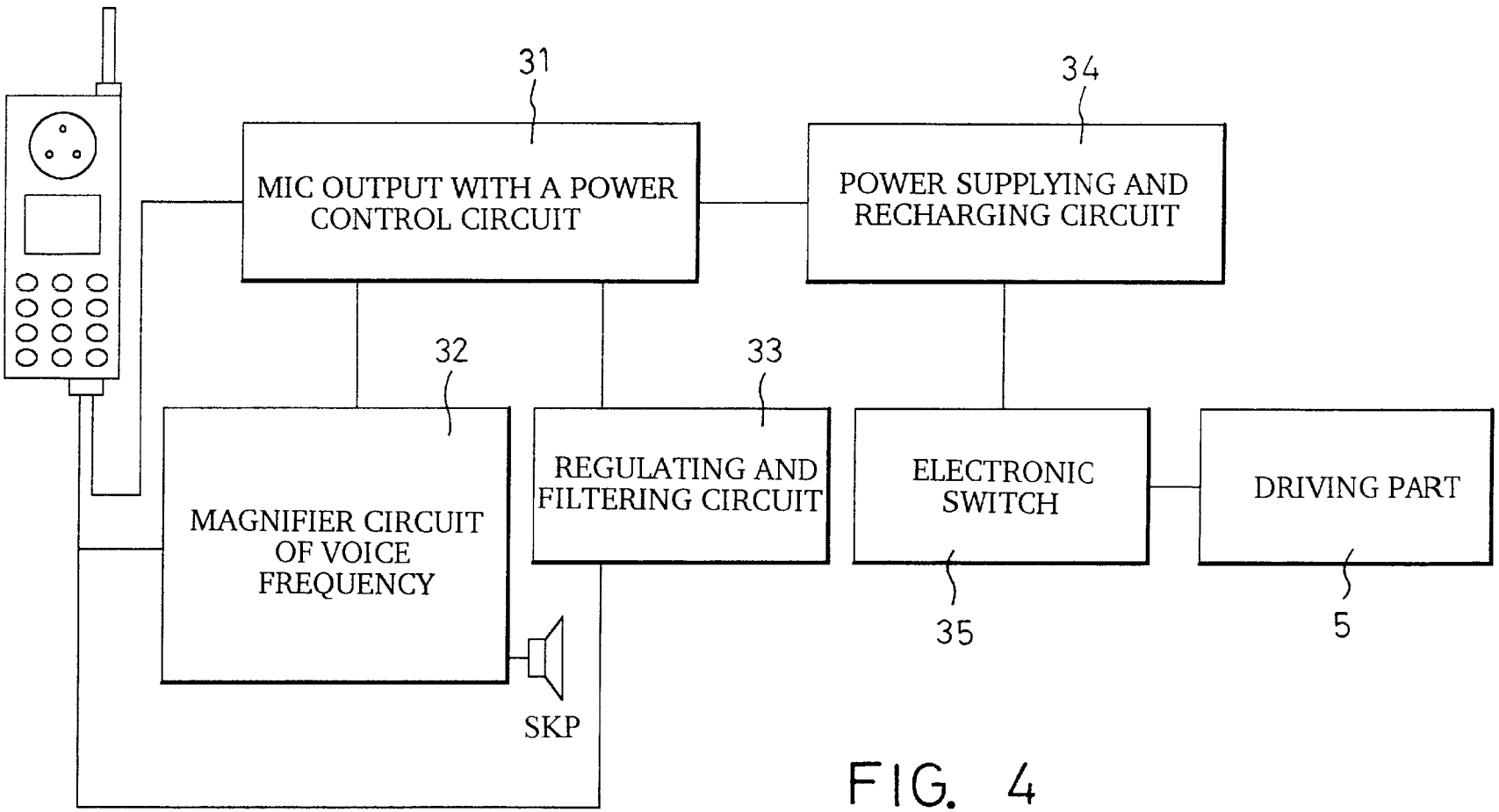
FIG. 4 is a block diagram for a circuit in the driving apparatus shown in FIG. 2 illustrating the circuit connecting with a mobile phone.

Referring to FIG. 4, the circuit board 3 contains conventional circuits such as a MIC output with a power control circuit 31, a magnifier circuit of voice frequency 32, a regulating and filtering circuit 33, and a power supplying and recharging circuit 34. Nevertheless, the power supplying and recharging circuit 33 extends to connect with an electronic switch 35 and the electronic switch 35 connects and controls the driving part 5. As shown in FIG. 2, the electronic switch 35 further connects with a telephone apparatus set or a mobile phone and the control switch 11. Furthermore, the electronic switch 35 externally connects a microphone 36 and a trumpet 37 for admitting the voice from the phone.

The housing 4 is composed of two opposite housing halves and the driving part 5 is received therein. A lateral side of the housing 4 is provided with multiple openings closely next to each other for being passed through the sound from the trumpet 37. Both of the housing halves are oppositely engaged to each other while assembling together. One of the housing halves has a groove 41 formed by two flaps for locating a swinging cam 57. The housing halves at the inner wall thereof extend a post with an engaging hole 42 respectively.

Figure 3:
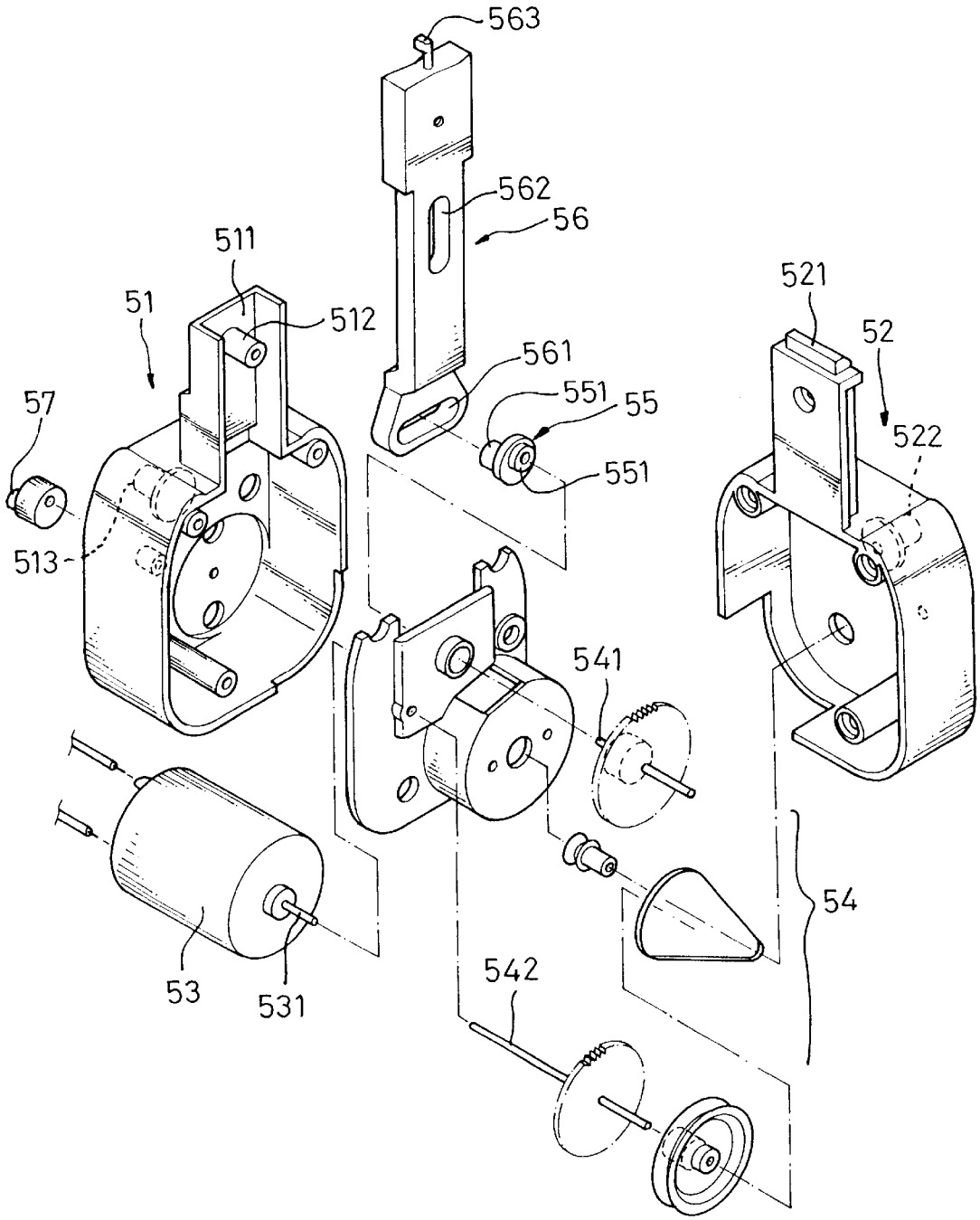
FIG. 3 is an exploded perspective view of a driving part shown in FIG. 2.

As shown in FIG. 3, the driving part 5 is composed of a left casing half 51, a right casing half, a motor 53, a speed reduction mechanism 54, an output cam shaft 55, a moving handle 56, and the swinging cam 57.

A straight rail 511 on the left casing half 51 is used for limiting the upward and downward movement of the moving handle 56. An engaging projection 512 is located at the upper part of the straight rail 511 for limiting the moving handle 56 and a room at the lower part of the straight rail 511 receives the motor 53 and the speed reduction mechanism 54. The right casing part 52 engages with the left casing part 51 to enclose the parts therein and at the top thereof has an upper part 521 for pressing against a lower lip plate 62. Besides, the left casing part 51 and the right casing part 52 at the outer surface thereof extend a left engaging projection 513 and a right engaging projection 522 respectively for fitting with the engaging hole 42 on the housing 4.

The motor 53 is controlled by way of the electronic switch 35 and has an output shaft 531 to be associated with speed reduction mechanism 54.

The speed reduction mechanism 54 provides a function to slow down the speed of the output shaft 531 on the motor 53 such that the speed reduction mechanism 54 is composed of conventional transmission parts such as a belt, and gear set. The output gear shaft 541 in the speed reduction mechanism 54 fits with the output cam 55 and the speed reduction mechanism 54 comprises another output of swinging gear shaft 542.

The output cam 55 is formed by two eccentric shafts 551 and one of the eccentric shafts 551 fits with the output gear shaft 541 so as to be driven by the output gear shaft 541.

The moving handle 56 is elongated shape and has a transverse elongated hole 561 at the lower part thereof for fitting with another eccentric shaft 551 and a vertical elongated hole 562 at the middle part thereof for fitting with the engaging projection 512. The rail 511 has a width corresponding to the width of the moving handle 56 such that the moving handle can slide along the rail 511. Furthermore, the moving handle at the upper end thereof has a hook projection 563 extends outward for engaging a spring 65 on the driven part 6.

The swinging cam 57 is a dual eccentric cam and mounted outside the left casing half 51 on the driving part 5 to fit with the swinging gear shaft 542 so as to be driven by the swinging gear shaft 542.

As shown in FIG. 2, the driven part 6 is provided with an upper lip plate 61 and a lower lip plate 62. The lower lip plate 62 has an engaging hole 63 being passed through by a pivot pin 64 such that the lower lip plate 62 can pivot up and down with respect to the pivot pin 64. Meanwhile, an end of a spring 65 is associated with the lower plate 62 and another end thereof is hooked to the hook projection 563. The upper lip plate 61 and the lower lip plate 62 are normally shut. When the moving handle moves downward, the lower lip plate is pressed by the upper part 521 on the right casing half 52 and the lower lip plate 62 at the front section thereof moves downward with respect to the pivot pin 64 to constitute a state of opening.

Referring to the figures again, an explanation of assembling the driving apparatus of the present invention will be described hereinafter. First of all, the driving part 5 is fixed and the eccentric shafts 551 fits with the transverse hole 561. The vertical hole 562 fits with the engaging projection 512 and the motor 53 and the speed reduction mechanism 54 are received in the left casing half 51 and the right casing half 52 to couple with each other. The swinging cam 57 extends out of the left casing half 51 right at this moment to fit with the swinging gear shaft 542. Afterward, the left engaging projection 513 and the right engaging projection 522 are fit with the engaging holes 42 in a state of non-tight fit. The swinging cam 57 is disposed in the groove 41 on the housing 4 accordingly. Finally, the driven part 6, the circuit board 3 and the battery case 2 are placed in the outer cover 1 and the extended electric wires may be connected with a mobile phone or a conventional telephonic apparatus set. The microphone 36 is for the voice from the phone.

In practice, the electronic switch 35 starts the driving apparatus of the present invention to be in a state of receiving. When the voice inputs, the motor 53 runs to allow the swinging cam 57 to swing the driving part 5 under a restriction of the groove 41. In the mean time, the eccentric shaft 551 on the output cam shaft 55 actuates to move the moving handle 56 upward and downward between limits of vertical hole 562 and the engaging projection 512. When the moving handle 56 moves downward to the lowest point, the lower lip plate 62 is pressed by the upper part 521 on the tight casing half 52 to move in a state of opening. The movement repeats over and over to constitute the doll keeping moving the mouth thereof in a state of opening and shutting and the body thereof in a state of swinging. When a communication is finished, the doll is returned to the unmoved position.

It is noted that the driving apparatus allows us to away from the mobile phone and prevent from the electromagnetic wave. Furthermore, the movement of the doll enhances a fun of amusement.

While the invention has been described with reference to a preferred embodiment thereof, it is to be understood that modifications or variations may be easily made without departing from the spirit of this invention, which is defined by the appended claims.

What is claimed is:

1. A telephone actuated driving mechanism for moving a movable part of an ornamental doll, the driving mechanism comprising:

a) a housing configured to be located within the ornamental doll;

b) a telephone actuated circuit located within the housing and comprising: a circuit board with a microphone output and power control circuit, a voice frequency magnifier circuit, a power supplying and recharging circuit and a regulating and filtering circuit; a speaker connected to the circuit board; and an electronic switch adapted to be connected to a telephone whereby sounds transmitted from the telephone are played through the speaker;

c) a driving mechanism comprising: a casing at least partially located within the housing, the casing having an upper part extending from the housing; a movable handle movably mounted to the casing and extending therefrom adjacent to the upper part, the movable handle extending from the housing and having an elongated transverse hole through a portion located within the casing; an eccentric cam engaging the transverse hole and rotatably mounted within the casing; and a drive motor located within the casing and drivingly connected to the eccentric cam so as to rotate the eccentric cam, rotation of the eccentric cam causing linear reciprocating movement of the movable handle; and, d) a driven mechanism comprising: an upper leg plate connected to the movable handle so as to move therewith; and a lower lip plate movable with respect to the upper lip plate, whereby movement of the movable handle toward the casing causes engagement of the lower lip plate with the upper part of the casing thereby causing the lower lip plate to move relative to the upper lip plate.

2. The telephone actuated mechanism of claim 1 further comprising an electrical power source located in the housing.

3. The telephone actuated mechanism of claim 1 further comprising a gear mechanism drivingly connecting the motor and the eccentric cam.

4. The telephone actuated mechanism of claim 3 wherein the gear mechanism comprises a speed reducing gear mechanism.

5. The telephone actuated mechanism of claim 1 further comprising a microphone connected to the circuit board.

* * * * *